United States Patent [19]

Hooper

[11] Patent Number: 4,495,669

[45] Date of Patent: Jan. 29, 1985

[54] DUAL-GRIP HANDLE BRUSH FOR PAINTING AND THE LIKE

[76] Inventor: Roger Hooper, P.O. Box 14271, Baton Rouge, La. 70898

[21] Appl. No.: 456,246

[22] Filed: Jan. 6, 1983

[51] Int. Cl.[3] ..... A46B 5/02

[52] U.S. Cl. ..... 15/143 R; 15/192; D4/130

[58] Field of Search ..... 15/143 R, 230.11, 192, 15/193, 194; D4/10–38.1

[56] References Cited

U.S. PATENT DOCUMENTS 2,914,785 12/1959 Ela ..... 15/143 R 4,157,598 6/1979 Talent et al. ..... 15/143 B 4,263,690 4/1981 Dobosi ..... 15/230.11

*Primary Examiner*—Peter Feldman

*Attorney, Agent, or Firm*—Keaty & Keaty

[57] ABSTRACT

A paint brush which has an elongated handle defining a sheath for holding a brushing means, an enlarged portion attached to the sheath, a neck portion, and a hand gripping portion connected to said neck portion. A pistol-grip handle is connected to the neck portion and extends outwardly from the brushing means at an angle of approximately means at an angle of approximately 60° with respect to the central axis.

7 Claims, 4 Drawing Figures

DUAL-GRIP HANDLE BRUSH FOR PAINTING AND THE LIKE

BACKGROUND OF THE INVENTION

1. FIELD OF THE INVENTION

The present invention relates generally to a handle for paint brushes or the like, which facilitates a variety of comfortable and efficient gripping positions, thereby enabling the user to employ the brush in a broader array of applications and contexts, and to use the brush in an easier, more efficient, and less fatiguing manner.

2. BACKGROUND OF THE INVENTION

There presently exists a number of paint brushes which are provided with a pistol-grip handle for facilitating efficient and comfortable manipulation thereof, such as those taught by U.S. Pat. Nos. Des. 167,775, Des. 255,845, Des. 212,668, Des. 199,520, and 2,914,785. The present invention is easily distinguishable over this prior art, however, as none teach the specific combination of the present invention, which combination facilitates more comfortable, efficient, and versatile usage of the paint brush. The most relevant prior art is U.S. Pat. No. 2,914,758, which merits the following comparative discussion.

U.S. Pat. No. 2,914,785 teaches a paint brush handle having two or more finger-receiving holes, a pistol-grip portion disposed rearwardly of said holes, and an off-center, longitudinally elongated portion extending rearwardly of said pistol-grip portion. Among the problems and disadvantages with this particular structural configuration of the prior art are that the structural integrity of the handle is considerably weakened by said holes provided therethrough, said pistol-grip portion is not provided with finger-conforming grooves which would enable more comfortable and efficient gripping of the brush, and said rearwardly extending, longitudinally elongated portion has proven to be difficult and awkward to manipulate due to it being positioned substantially removed from the central axis of the handle, thereby severely limiting the versatility of deployment of the brush therewith, thereby rendering it inefficient vis-a-vis the apparatus of the present invention, as will hereinafter be clearly seen.

The present invention basically comprises, in the preferred embodiment, a first portion to which the bristles are securely attached thereto, a pistol-grip portion extending rearwardly therefrom, wherein the pistol-grip handle is provided with finger-conforming grooves which enable the brush-user to comfortably and firmly grip it, and a longitudinally elongated portion extending rearwardly from said pistol-grip portion at least substantially along the central/longitudinal axis of the brush, thereby facilitating a more comfortable and efficient gripping of the pistol-grip handle by preventing the hand from sliding up the pistol-grip handle, and further, said longitudinally elongated portion can be gripped in the same manner as a conventional paint brush handle, thereby enabling the user to reach areas which are otherwise inaccessible, which has not been possible with the brush handles of the prior art, due to the total absence of the longitudinally elongated portion with most of the pistol-grip handles presently in existence, or, as is the case with U.S. Pat. No. 2,914,785, the mispositioning of the longitudinally elongated portion, thereby rendering it awkward, uncomfortable, and inefficient to manipulate. Also, by inverting the handle of the present invention, the user can grip the longitudinally elongated portion more firmly and comfortably, as will hereinafter be more clearly seen, thereby preventing slippage of the hand up the handle and preventing excessive fatigue when painting for long periods of time.

Also, it will clearly hereinafter be seen that the paint brush handle of the present invention facilitates the alternate gripping of the paint brush handle between the pistol-grip portion and the longitudinally elongated portion, in a much easier and rapid manner than has been theretofore possible with the devices of the prior art.

Many other objects and advantages of the present invention will become readily apparent from the following detailed description when taken in conjunction with the accompanying drawings, wherein:

DETAILED DESCRIPTION OF THE PREFERRED EMBODIMENT

Figure 1:
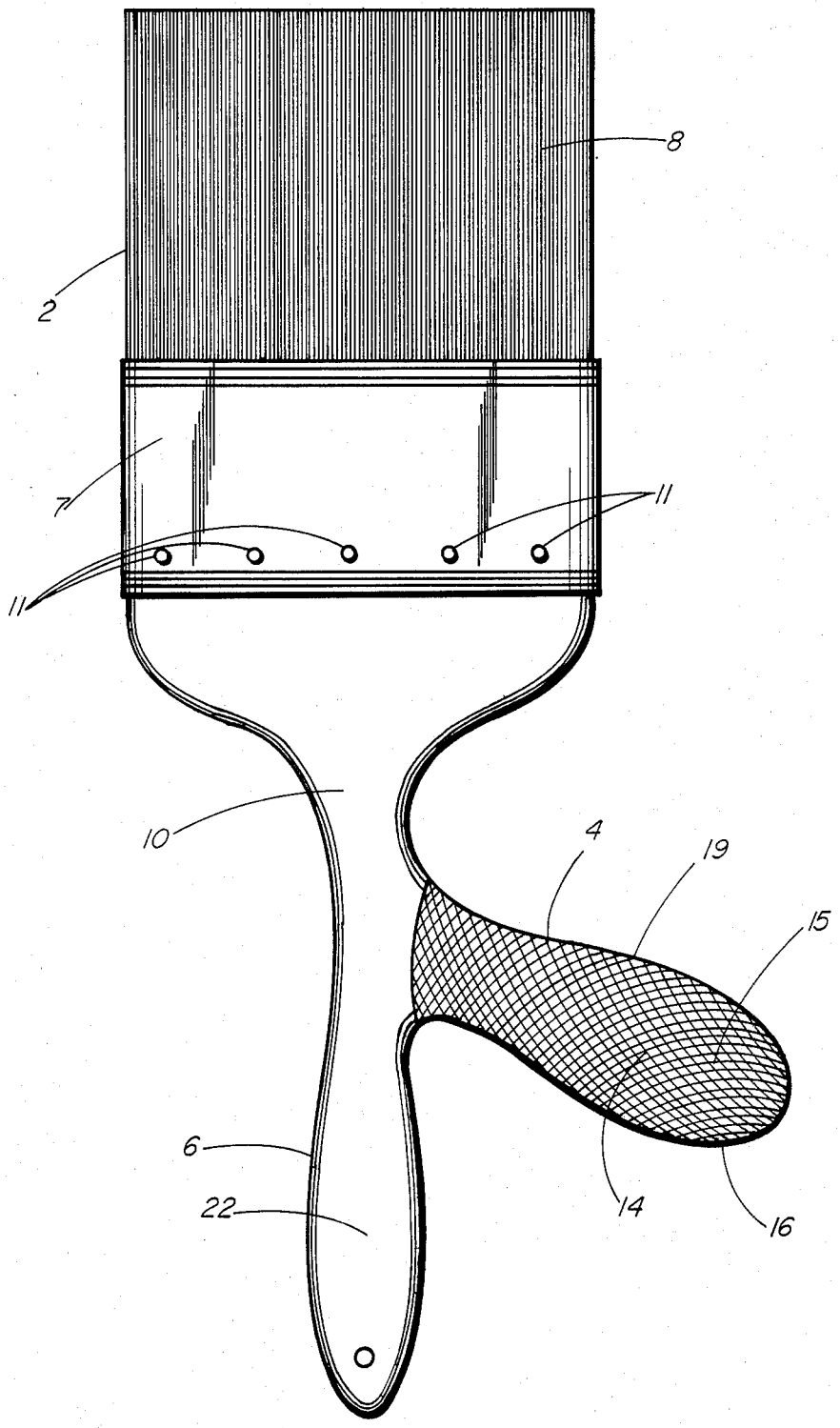
FIG. 1 is an elevational, frontal view of the brush of the present invention, in isolation.

Referring now to FIG. 1, there can be seen the preferred embodiment of the dual-comfort brush of the present invention, in isolation, indicated generally by the numeral 1, wherein it is shown to comprise a brush body portion 2, a pistol-grip portion 4, and a longitudinally elongated handle member 22 having a hand gripping portion 6.

In the preferred embodiment, again referring to FIG. 1, brush body portion 2 comprises a sheath 7 which securably holds the usual bristles 8, or any other suitable brushing medium, for use in painting the like. Pistol-grip portion 4 preferably comprises a neck portion 10 which as shown, has an enlarged portion that is attached by means of set screws 11 or any other suitable attachment means, such as rivets or the like, to sheath 7, at least substantially in alignment with the central, vertical axis thereof, and a pistol-grip handle portion 14, which is preferably fixably attached to, for example, integrally formed with neck portion 10, at any suitable angle thereto, shown in FIG. 1 at an approximately 60° angle thereto. Pistol-grip handle portion 14 is preferably provided with a serrated gripping surface on diametrically-opposed faces 15, 16 thereof, and a plurality, preferably four, of finger-conforming grooves 18 preferably provided on the finger-receiving inner side 19 thereof, for reasons which will be lucidly delineated in the description of the manner of use of the present invention. Longitudinally elongated hand gripping portion 6 preferably comprises a longitudinally elongated, preferably smooth-surfaced handle, suitably the same as a conventional paint brush handle, preferably fixably attached to, for example, integrally formed with, pistol-grip handle portion 14, at least substantially in alignment with the central, vertical axis of neck portion 10.

The brush body portion 2, the pistol-grip portion 4, and longitudinally elongated portion 6, abovedescribed, can all be suitably made of wood, plastic, rubber, or any other suitable material.

Figure 2:
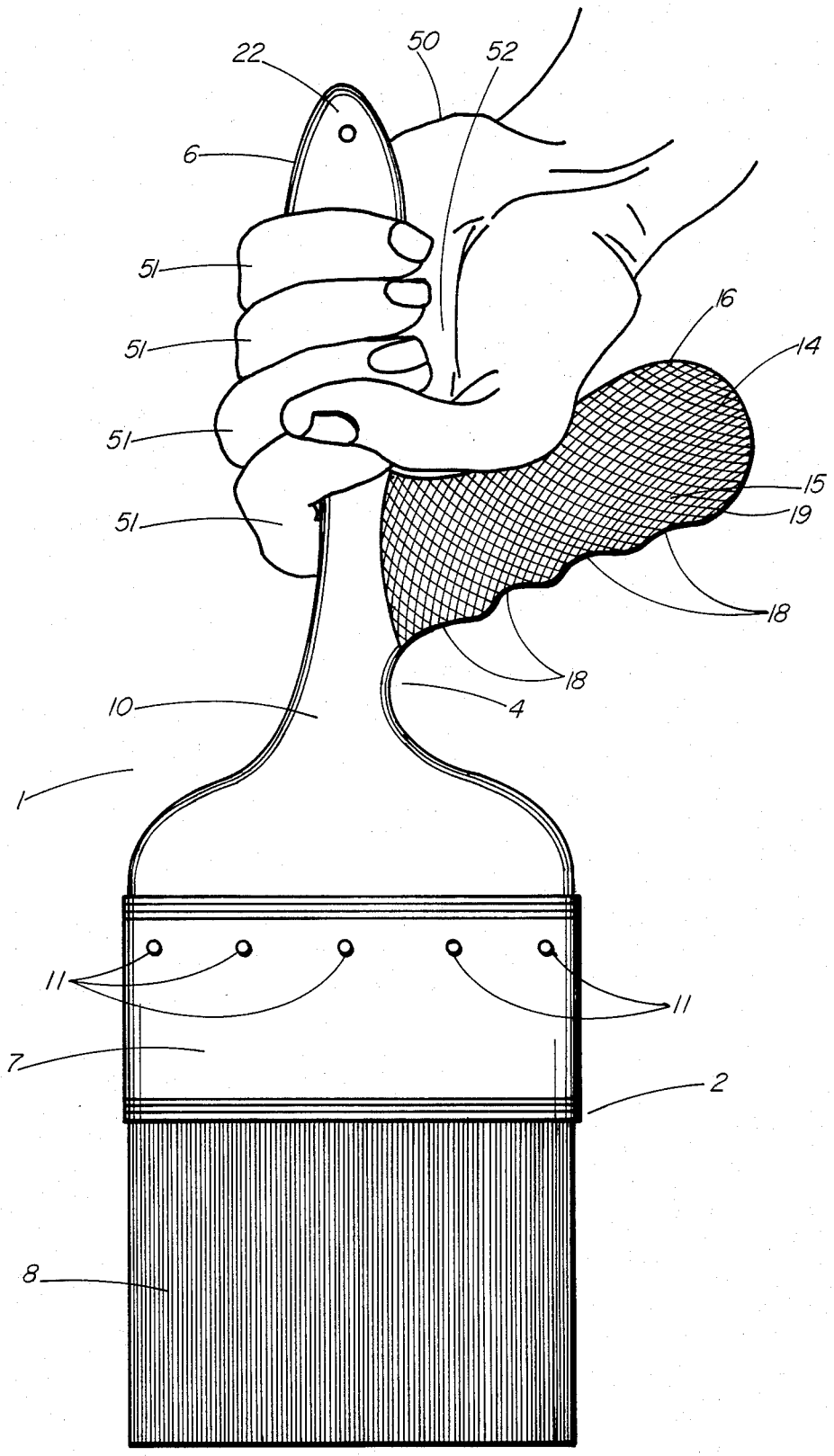
FIG. 2 is an elevational, frontal view of the brush of the present invention, showing one gripping position for use thereof.
Figure 3:
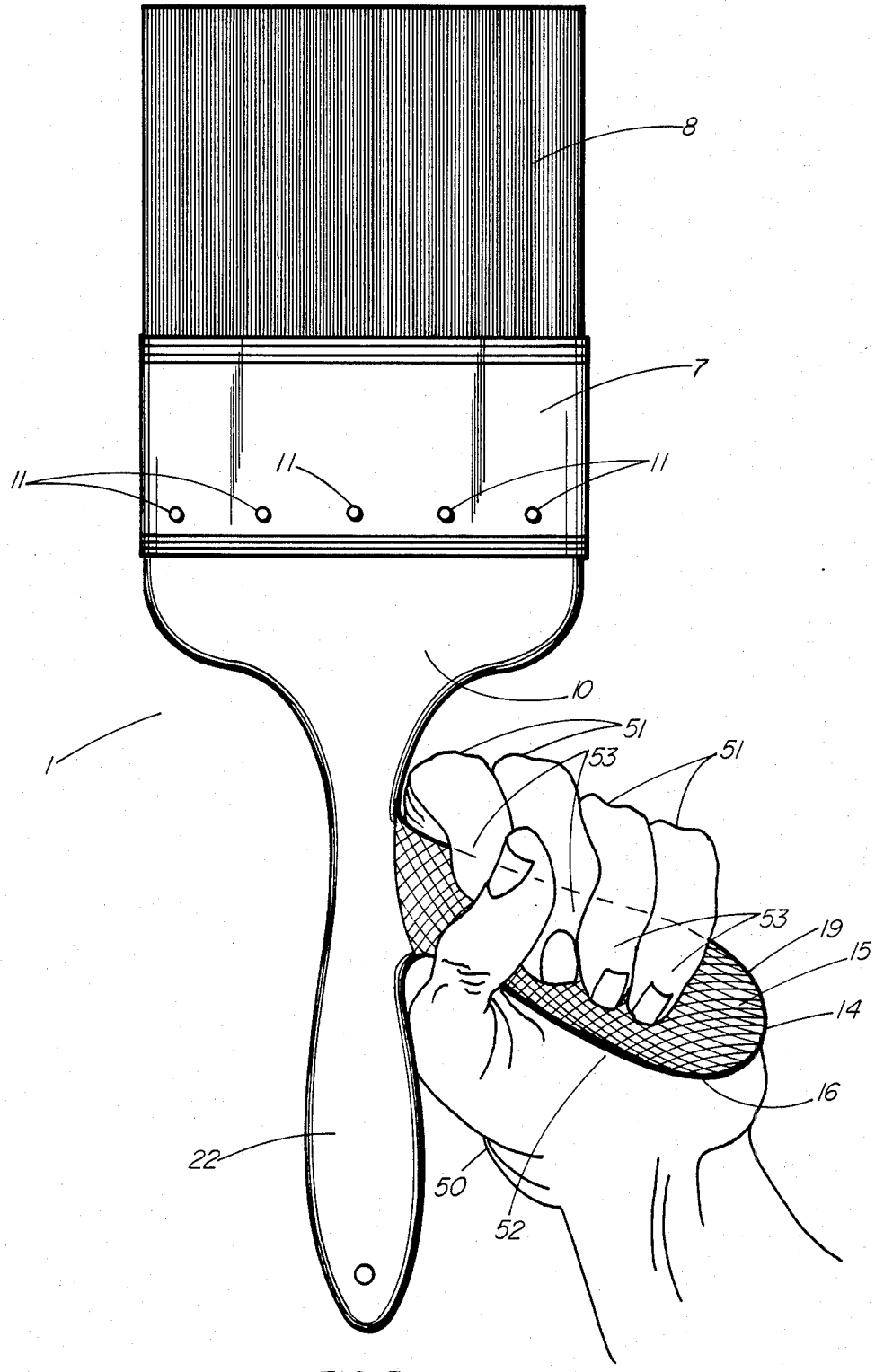
FIG. 3 is an elevational, frontal view of the brush of the present invention, showing another gripping position for use thereof.
Figure 4:
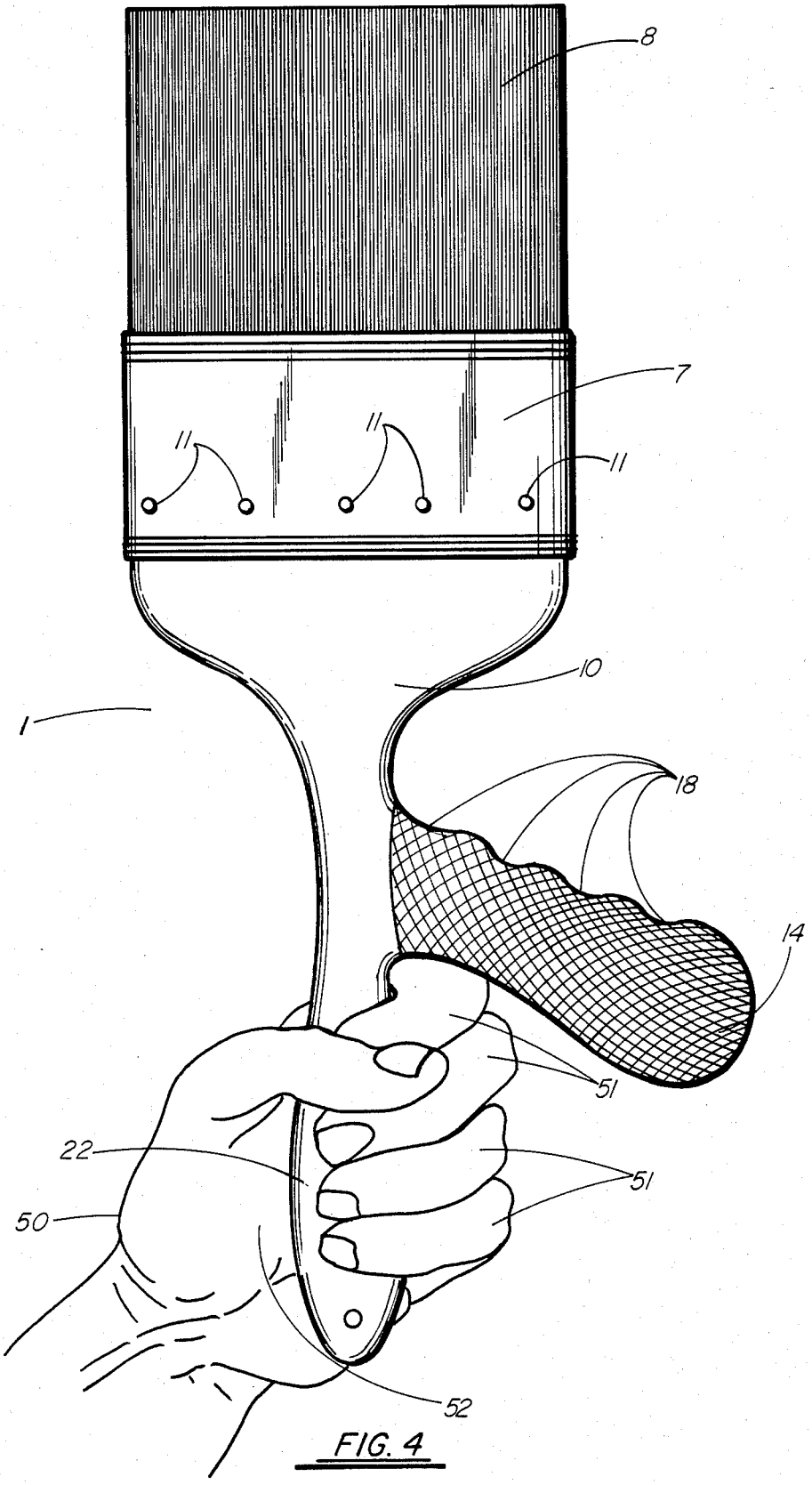
FIG. 4 is an elevational, frontal view of the brush of the present invention, showing yet another gripping position for use therof.

The present invention can be used for painting or the like, in the following illustrative ways, which should in no way, be read to limit the scope of the present invention at all:

1. The user, as illustrated in FIG. 2, can firmly grasp his hand 50 around pistol-grip handle portion 14, in the normal manner, preferably, wherein each finger 51 thereof is inserted into the appropriate groove 18 of inner side 19 of handle portion 14, and the palm 52 thereof is placed in firm communication with the serrated gripping surface provided on outer face 16 of handle portion 14, whereby the outer ends 53 of fingers 51 will be in firm communication with the serrated gripping surface provided on inner face 15 of handle portion 14—after the user has firmly gripped pistol-grip handle portion 14, he/she can merely stroke brush body portion 2 in a back and forth manner, for example, thereby causing the bristles 8 thereof to engage a work surface (not shown), thereby facilitating the application of paint (not shown) or the like thereto, in the usual manner, except that, importantly, the grooves 18 and serrated gripping surfaces of handle portion 14 enable the user to have a firmer, more efficient, and more comfortable grip, and longitudinally elongated portion 6 prevents slippage of hand 50 upwardly along handle portion 14; or, 2. The user, as illustrated in FIG. 3, can firmly grasp his hand 50 around longitudinally elongated, preferably smooth-surfaced handle 22 of longitudinally elongated portion 6, in the normal manner, preferably, when it is desired to paint, for example, in certain areas which are normally inaccessible by using pistol-grip handle portion 14, thereby enabling the user to use brush 1 as an ordinary brush—one illustrative example of a situation which renders using longitudinally elongated portion 6 is when it is desired to dip brush 1 into a can of paint (not shown), for coating bristles 8 with fresh paint—in this gripping position, pistol-grip handle portion 14 prevents hand 50 from slipping upwardly along handle 22 of longitudinally elongated portion 6, thereby enabling the user to more comfortably, efficiently, and firmly grip and manipulate brush 1 for a variety of applications—also, it is important to note, that the switch from the gripping of pistol-grip handle portion 14 and handle 22 of longitudinally elongated portion 6 is made to be easy, rapid, and efficient due to the particular structural combination of elements herein taught by the present invention, thereby enabling the user to alternate between gripping positions in a rapid, efficient, and easy manner, which was heretofore impossible with the devices of the prior art; or, 3. The user, as illustrated in FIG. 4, can merely invert brush 1, and firmly grasp his hand 50 around handle 22 of longitudinally elongated portion 6, in the normal manner, except that a more efficient, more comfortable and more secure/firm grip is facilitated, for painting in certain areas, as the angle of pistol grip handle portion 14 is now towards the user, thereby also eliminating excessive fatigue when the user is painting for long periods of time.

Although the present invention has been described in some detail, and three illustrative examples have been given of possible uses thereof, it should be clearly understood that there are many variations to these gripping positions described and to the specific embodiment herein taught, and therefore, said detailed description should not be read in a limiting sense; for example, when the user inverts the brush 1, he could grip the pistol-grip handle portion 14, rather than handle 22 of longitudinally elongated portion 6 as described in 3. above within the description of possible uses of the present invention. Also, it is obvious that bristles 8 of brush body portion 2 can be replaced by any other suitable apparatus, such as a steel shave blade (not shown) for scraping paint from work surfaces. Accordingly, the scope of the present invention should be clarified by the following appended claims, wherein:

What is claimed is:

1. A dual-grip paint brush comprising:

a. a brush body portion having a brushing means and a sheath for securably holding said brushing means, said sheath having a central axis;

b. a longitudinally elongated handle member extending along said central axis of said sheath, said handle member comprising an enlarged portion attached to said sheath, a neck portion, and a hand gripping portion connected to said neck portion;

c. a pistol-grip handle connected to said neck portion, said pistol-grip handle extending outwardly away from said brushing means at an angle of approximately 60° with respect to said central axis.

2. The brush of claim 1, wherein said brushing means comprises brushing bristles.

3. The brush of claim 1, wherein said pistol-grip handle has an inside face and an outside face provided in diametric opposition to each other, and an inner finger-receiving side and an outer palm-receiving side disposed in diametric opposition to each other.

4. The brush of claim 3, wherein said inside face and said outside face of said pistol-grip handle are each provided with a generally serrated gripping surface.

5. The brush of claim 4, wherein said inner, finger-receiving side of said pistol-grip handle is provided with a plurality of finger-receiving grooves for conforming to a user's fingers.

6. The brush of claim 5, wherein said inner, finger-receiving side of said pistol-grip handle is provided with four finger-receiving grooves.

7. The brush of claim 3, wherein said outer, palm-receiving side of said pistol-grip handle is provided with a generally serrated gripping surface.

* * * * *